US005608949A

United States Patent [19]

Cooley et al.

[11] Patent Number: 5,608,949

[45] Date of Patent: Mar. 11, 1997

[54] FASTENABLE BAG CLOSURE

[75] Inventors: June E. Cooley; Anna H. Mack, both of Lake Oswego, Oreg.

[73] Assignee: Kolor Kollar, Inc., Portland, Oreg.

[21] Appl. No.: 527,513

[22] Filed: Sep. 13, 1995

[51] Int. Cl.[6] ..... B65D 77/00

[52] U.S. Cl. ..... 24/30.5 R; 24/30.5 L; 383/42

[58] Field of Search ..... 24/30.5 R, 30.5 L; 40/658, 666; 383/42, 58

[56] References Cited

U.S. PATENT DOCUMENTS

| | | | |
|---|---|---|---|
| D. 239,919 | 5/1976 | Wilson | D9/191 |
| 1,437,362 | 11/1922 | Rius et al. | 383/42 |
| 1,601,129 | 9/1926 | MacNeil | 40/666 |
| 2,220,409 | 11/1940 | Kellogg | 24/30.5 R |
| 2,411,368 | 11/1946 | Dow | 40/661 |
| 2,452,098 | 10/1948 | Brooks | 24/30.5 R |
| 2,599,738 | 6/1952 | Ames | 24/30.5 R |
| 3,373,925 | 3/1968 | Gatward | 229/54 |
| 3,561,808 | 2/1971 | Beier et al. | 24/30.5 R |
| 4,836,690 | 6/1989 | Cheng | 383/42 |
| 5,165,800 | 11/1992 | Downey | 383/78 |

FOREIGN PATENT DOCUMENTS

| | | | |
|---|---|---|---|
| 0013296 | 9/1909 | United Kingdom | 40/666 |

OTHER PUBLICATIONS

Article: "Gift Wrap Idea: big bags with folded cards," *Sunset Magazine* (Dec. 1991) 1 page.

*Primary Examiner*—Victor N. Sakran

*Attorney, Agent, or Firm*—Klarquist Sparkman Campbell Leith & Whinston, LLP

[57] ABSTRACT

A bag closure for securely closing a handled shopping bag or the like. The bag closure includes a thin, flexible piece of material having an elongated center strip and a pair of flaps pivotably mounted to opposite sides of the center strip. The center strip defines a slot therein for receiving the handles of a bag. Attached to each of the flaps is a fastener such as adhesive double stick tape for fastening the flap to a side of a bag. To close a bag with the bag closure, the bag handles are slipped through the bag closure slot and the flaps bent to press and fasten against the bag sides. The bag closure fasteners may be fastened and unfastened multiple times, permitting the bag closure to be used over and over again with the same or different bags. The bag closure fastener can also be made so that once the closure is secured, it may be recognizable that the bag was tampered with if opened.

1 Claim, 1 Drawing Sheet

FASTENABLE BAG CLOSURE

FIELD OF THE INVENTION

This invention relates to bag closures and, particularly, to a reusable bag closure adapted to securely close a bag.

BACKGROUND OF THE INVENTION

Commercial marketers have discovered that bags can serve as a billboard to broadcast or distribute information. One prevalent bag type in widespread use is made of paper with stiff rope-like handles. These bags are favored because they are sturdy and easy to carry. Further, these bags can serve as an effective marketing tool when the name of the retailer and other promotional information are printed on the bag.

However, these bags have a number of drawbacks. First, some promotional materials may be seasonal or become obsolete. Thus, bags with stale information printed on them must be discarded and new ones created with more recent advertisements. Even with recent recycling efforts, this is an inefficient and expensive use of resources.

Second, it is difficult to securely close the top of the bag. Consequently, objects within the bag can be easily stolen or fall out, especially if the bag is placed on the ground. Additionally, the contents of an open bag are easily seen by passersby, providing little, if any, privacy or security.

An objective of the invention, therefore, is to provide an improved bag closure on which advertising can be printed for use with bags. The bag closure eliminates the need for printing the advertising directly on the bag. The improvement allows the bag closure to securely close the bag to keep the contents protected therein.

SUMMARY OF THE INVENTION

The present invention relates to a bag closure that permits updating of advertisements on a bag while keeping the bag securely closed.

In a preferred embodiment of the invention, a bag closure may include an elongated planar strip having a slot therein adapted to receive the handles of the bag. A pair of flaps are pivotably joined to opposing sides of the elongated strip and are adaptable to fold over the outside of a bag to keep the bag closed.

The above-described features and advantages of the present invention will be more readily apparent from the following detailed description of a preferred embodiment, which proceeds with reference to the accompanying drawings.

DETAILED DESCRIPTION OF THE PREFERRED EMBODIMENT

Figure 3:
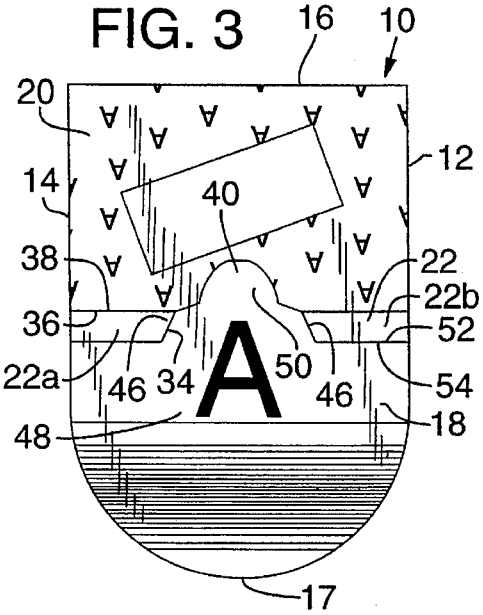
FIG. 3 is a top view of the bag closure of FIG. 1 in a closed position.

FIG. 3 shows a bag closure 10 in a closed position. The bag closure is preferably made of a planar, thin flexible material such as paper and having sides 12, 14 and ends 16, 17. Bag closure 10 includes a pair of complementary flaps 18, 20 positioned on opposite sides of a narrow, elongated planar strip 22, which extends between sides 12, 14 and is centered between ends 16, 17.

Planar strip 22 is formed from two sections 22*a*, 22*b* that extend inwardly from sides 12, 14, respectively, to a slot 34 in the planar strip. The slot 34 is centered between sides 12, 14.

Flap 20 has a top edge 36 pivotably joined to a side edge 38 of planar strip 22. The flap also defines a recessed area 40 appearing as a wide-spread inverted U-shape extending between ends 46 of slot 34. The recessed area is connected to the slot so as to form an opening through the center of bag closure 10.

Flap 18 has major and minor portions 48, 50 respectively. The major portion has a top edge 52 pivotably joined to a side edge 54 of planar strip 22. Minor portion 50 projects from top edge 52 of the major portion and is sized and shaped to fit within slot 34 and recess 40. Thus, when in the closed position, planar strip 22 and flaps 18, 20 are coplanar and the slot and recess are filled by minor portion 50.

Flaps 18, 20 may have advertisements printed or otherwise mounted thereon. In the illustrated embodiment, a large letter "A" is printed on flap 18, extending from major portion 48 onto minor portion 50. Flap 20 similarly has an exemplary advertisement thereon.

Figure 4:
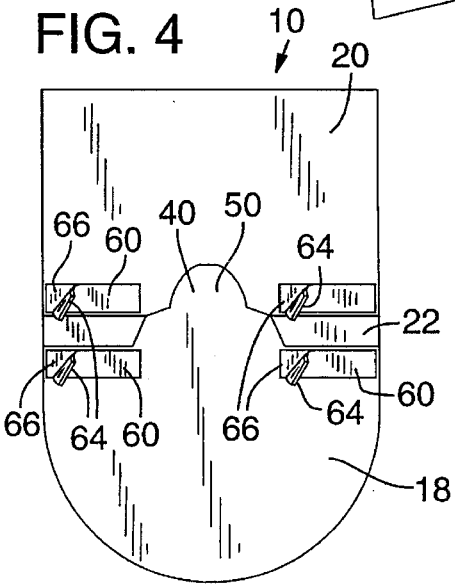
FIG. 4 is a bottom view of the bag closure of FIG. 1 in the closed position.

FIG. 4 shows a bottom view of bag closure 10 in the closed position. Fasteners in the form of four strips of double-sided tape 60 are placed on the bag closure. Each flap has two pieces of the tape thereon, placed on opposite sides of slot 34 and running parallel to and adjacent to planar strip 22. The tape is shown with a peelable coating 64 shown partially peeled to reveal adhesive 66 below. Although tape 60 is a preferred fastener, many types of alternative fasteners may be used such as adhesives, snaps, Velcro®-type material, etc.

Figure 5:
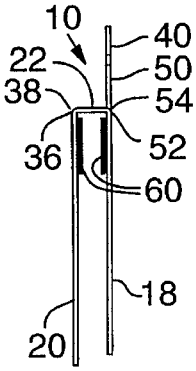
FIG. 5 is an elevational, side view of the bag closure of FIG. 1 in an open position.

FIG. 5 is a side view of the bag closure in the open position. When open, minor portion 50 projects outwardly from the rest of bag closure 10 to reveal slot 34 and recessed area 40. Planar strip 22 is perpendicular to portion 50 with flaps 18, 20 pivotably joined along strip edges 38, 54 respectively and depending perpendicularly therefrom. Double-sided tape 60 mounted on each flap are positioned opposite each other.

Figure 1:
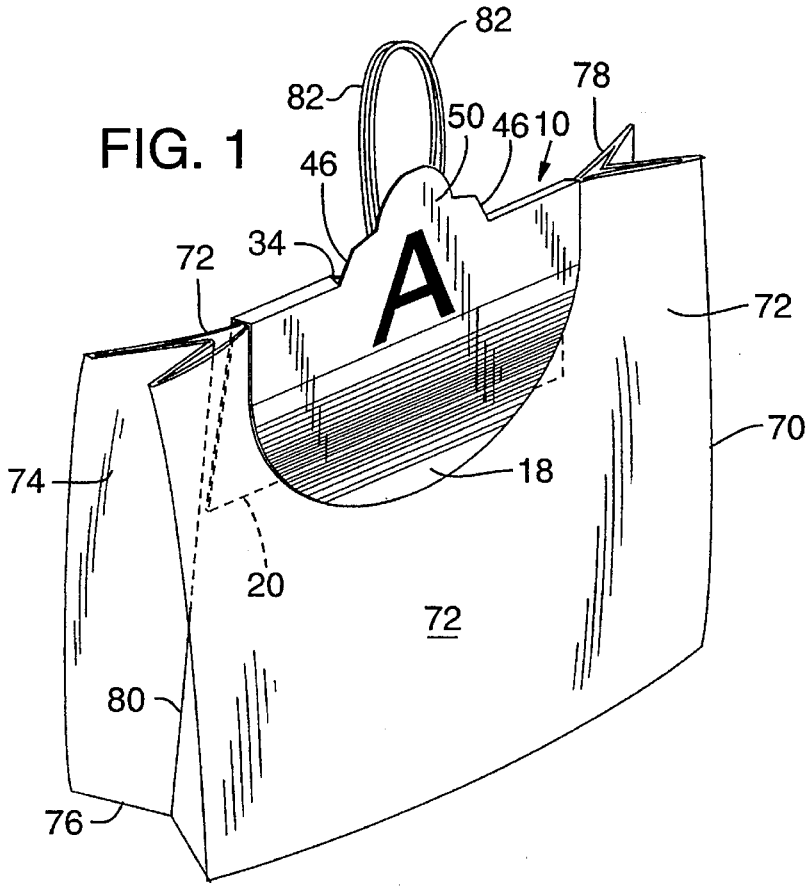
FIG. 1 is an isometric view of a bag closure according to the invention mounted on a bag and having exemplary advertisements thereon.
Figure 2:
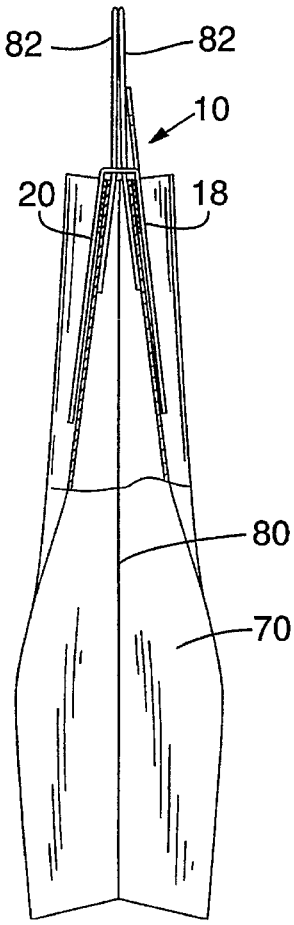
FIG. 2 is an elevational, side view of the bag and bag closure of FIG. 1.

FIGS. 1 and 2 show the bag closure mounted to a shopping bag 70, prominently displaying advertisements thereon. Bag 70 has sides 72, ends 74, a bottom 76 and a top 78. Ends 74 have center folds 80 therein running from the bottom of the bag to the top. The folds allow sides 72 to collapse together as shown. A pair of inverted U-shaped handles 82, one on each side of the bag, extend upright from the top of the bag and allow for the bag to be carried.

To insert bag closure 10 onto bag 70, double-sided tape 60 should first have peelable coatings 64 removed. The bag should then have sides 72 brought together by hand. The bag closure should be placed in the open position as shown in FIG. 5 so as to expose slot 34 and recess 40. Bag closure 10 should be placed over bag 70 with the handles extending through slot 34 and with flaps 18, 20 on opposite sides of and outside of bag 70. Bag closure 10 is properly seated when planar strip 22 is in contact with top 78 of the bag. The bag closure should then be pinched or otherwise pressed in the region of tape 60 to fasten flaps 18, 20 and thereby the bag closure to the bag.

The bag closure fasteners may be fastened and unfastened multiple times, permitting the bag closure to be used over and over again with the same or different bags. The bag closure fastener can also be made so that once the closure is secured, it may be recognizable that the bag was tampered with if opened.

As can better be seen in FIG. 2, the inverted U-shaped handles may be partially supported in their upright position by minor portion 50 of flap 18.

Having illustrated and described the principles of the invention in preferred embodiments, it should be apparent to those skilled in the art that the invention can be modified in arrangement and detail without departing from such principles. For example, although a slot and recessed area are shown, the bag closure can have only a slot in the planar strip or any similar variations thereof. Additionally, although the bag closure was shown with the planar strip and flaps all coplanar when in the closed position, this need not be the case. For instance, minor portion 50 of flap 18 could have extended so as to overlap with flap 20 and/or planar strip 22. Or minor portion 50 may be omitted entirely. Finally, while the invention was shown with double-sided tape as the fastener, alternative fasteners may be used.

Therefore, the illustrated embodiment should be considered only an example of the invention and not a limitation on the scope of the claims. We therefore claim as our invention all modifications and equivalents to the illustrated embodiment coming within the scope of the following claims.

We claim:

1. A bag closure having a closed position for storage and an open position for use with a bag having handles thereon, the bag closure comprising:

an elongated planar strip having a centrally-located slot therein adapted to receive the handles of the bag with the bag closure in the open position, the planar strip having first and second side edges and first and second ends, the bag closure having a longitudinal axis extending between the ends of the planar strip;

a first flap having a top edge pivotably joined to the first edge of the planar strip and having a recessed area therein adjacent the slot, the first flap depending downwardly from the planar strip when the bag closure is in the open position and being coplanar with the planar strip when the bag closure is in the closed position;

a second flap having a top edge pivotably joined to the second edge of the planar strip, the second flap depending downwardly from the planar strip when the bag closure is in the open position and being coplanar with the planar strip when the bag closure is in the closed position;

a tab projecting from the top edge of the second flap, the tab being substantially coextensive and coplanar with the slot and the recessed area in the first flap with the bag closure in the closed position so as to cover the slot and recessed area, the tab projecting above the planar strip with the bag closure in the open position so as to expose the slot in the planar strip and the recessed area; and one or more sections of double-sided tape on an inside surface of each flap, adapted for securing the flaps to the bag with the bag closure in the open position.

* * * * *